United States Patent [19]

Thompson, Jr

[11] 3,965,346

[45] June 22, 1976

[54] LIGHT FIXTURE MOUNTING APPARATUS

[75] Inventor: Joseph L. Thompson, Jr, San Marcos, Tex.

[73] Assignee: Esquire, Inc., New York, N.Y.

[22] Filed: July 14, 1975

[21] Appl. No.: 595,674

[52] U.S. Cl. ..... 240/52 R; 240/81 R

[51] Int. Cl.[2] ..... F21V 21/00

[58] Field of Search ..... 240/52 R, 41.15, 11.4 R, 240/81 R, 81 P, 81 BE, 73 R

[56] References Cited

UNITED STATES PATENTS

| | | | |
|---|---|---|---|
| 555,183 | 2/1896 | Rhind | 240/52 R |
| 2,732,487 | 1/1956 | Crider | 240/81 R |

FOREIGN PATENTS OR APPLICATIONS

| | | | |
|---|---|---|---|
| 924,081 | 3/1947 | France | 240/52 R |
| 1,067,950 | 5/1967 | United Kingdom | 240/52 R |

*Primary Examiner*—R. L. Moses

*Attorney, Agent, or Firm*—Arnold, White & Durkee

[57] ABSTRACT

A mounting bracket for a lamp fixture fixedly securable to a mounting pad on the fixture via a key-hole slot arrangement and providing adjustment for the fixture through an aiming range of nearly 180°.

4 Claims, 5 Drawing Figures

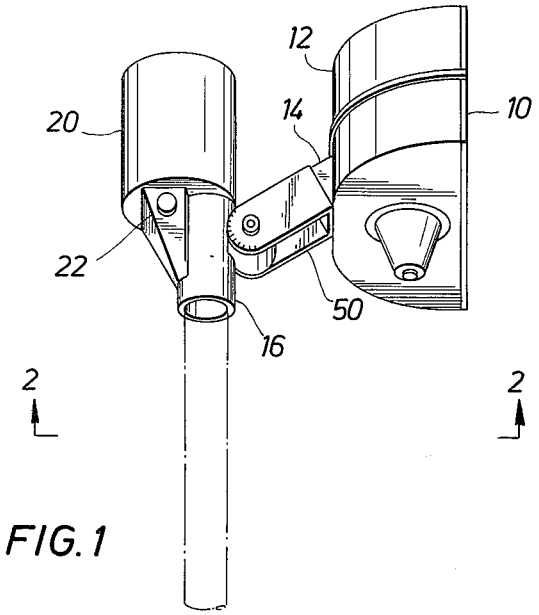
FIG. 1
FIG. 2
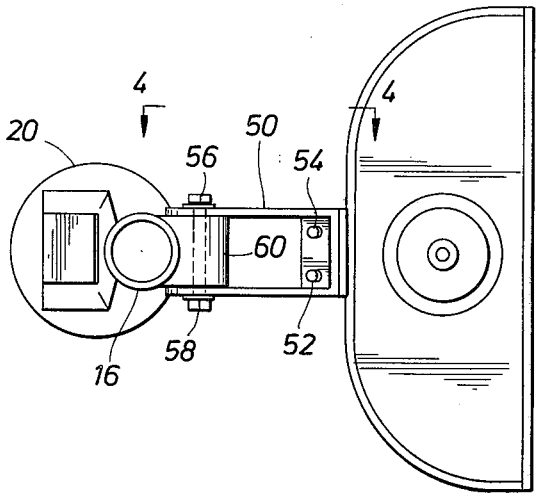
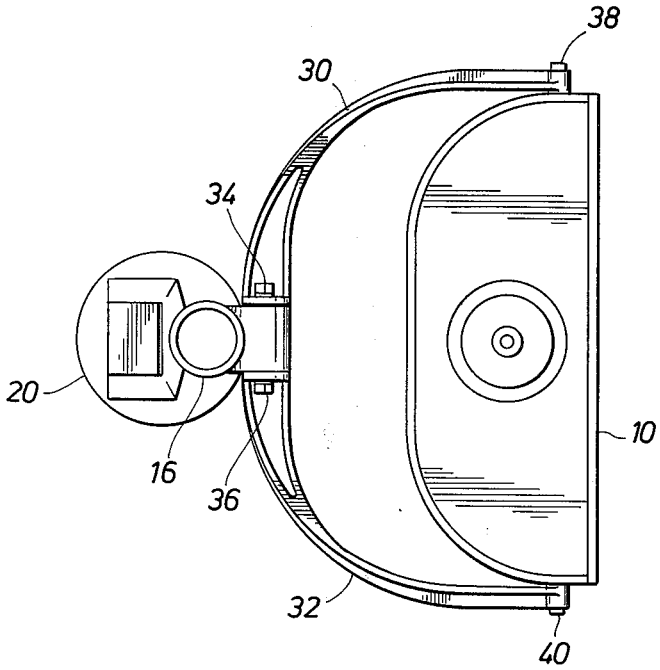
FIG. 3
PRIOR ART
FIG. 4
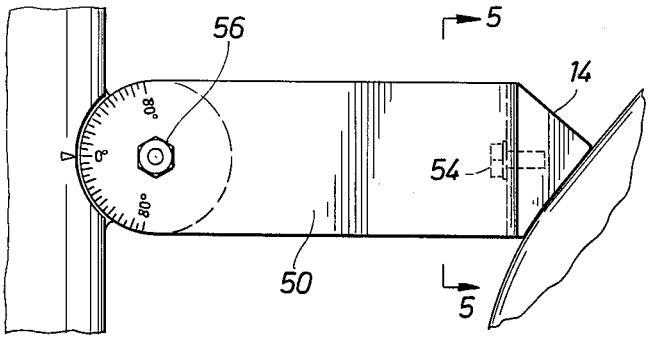
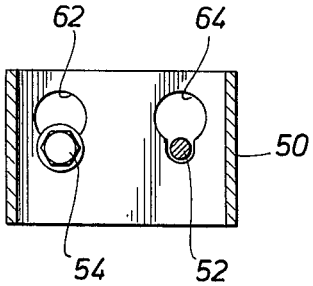
FIG. 5

LIGHT FIXTURE MOUNTING APPARATUS

BACKGROUND OF THE INVENTION

1. Field of the Invention

This invention relates to lighting fixtures, and more specifically to the bracket apparatus used for mounting a lighting fixture.

2. Description of the Prior Art

Mounting brackets for a lighting fixture which is not flushedly mounted in a ceiling may take the form of fixed attachment to a post. However, such an arrangement does not permit an adjustment to the aiming range which may be desirable for the fixture. That is, unless the direction of light from the fixture happens to be in the desired direction, no means is provided for making an adjustment. Should a subsequent change in aiming direction be desired, a remounting of the fixture would be required.

To alleviate such a problem, mounting means for lighting fixtures have included an annular tubing arrangement for slipping over a vertical post to permit adjustment of the fixture through a horizontal aiming range. Unless pivot means is also provided about a horizontal axis, however, vertical adjustment is not possible.

To provide a vertical adjustment, the prior art has utilized a pair of arms extending from a common point to surround at least a portion of the fixture. The attachment points where the arms are affixed to the fixture may be made to be pivot points, thereby providing the desired vertical adjustment.

Although convenient to provide such arms for surrounding the fixture in tubular products, lighting housings are generally made of castings. Casting arms of the above-described character is therefore convenient. Arms made of castings, however, may be relatively expensive in that they must utilize a high grade of metal in order to support the weight normally associated with large lighting fixtures. In addition, castings having an appreciable longitudinal dimension must be carefully inspected to avoid insidious flaws that could cause breakage after the lighting fixture has been installed.

It is therefore a feature of this invention to provide an improved lighting fixture bracket that is relatively inexpensive to fabricate in a flawless fashion and which provides adjustment through a large range of vertical adjustment for a lighting fixture mounted on a vertical post.

It is another feature of this invention to provide an improved mounting bracket for a lighting fixture which permits the lighting fixture to be temporarily mounted during installation without tools.

SUMMARY OF THE INVENTION

The lighting fixture housing disclosed herein includes an angled mounting pad secured to the casing. A U-shaped bracket is attached to the mounting pad via convenient keyhole slots in which bolts secured in the mounting pad may be temporarily secured during mounting. The U-shaped bracket is typically secured to a post receiving means via an axial or pivot arrangement separate and apart from the lighting fixture itself. Hence, the post receiving means may be moved through a range of aiming adjustments in one direction and the axial or pivot means provides movement of the light fixture through an aiming range in a direction at right angles thereto.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification. It is to be noted, however, that the appended drawings illustrate only a typical embodiment of the invention and are therefore not to be considered limiting of its scope, for the invention may admit to other equally effective embodiments. In the drawings:

FIG. 1 is an oblique view of a typical lighting fixture for a high intensity discharge lamp fixture showing a mounting bracket in accordance with the present invention.

FIG. 2 is a side view of the fixture shown in FIG. 1 taken at section 2—2.

FIG. 3 is a top view of a prior art lighting fixture mounting apparatus.

FIG. 4 is a partial view of section 4—4 shown in FIG. 2.

FIG. 5 is a front view of the mounting pad of the preferred embodiment of the mounting apparatus of the lighting fixture shown in FIG. 1.

DESCRIPTION OF PREFERRED EMBODIMENT

Now referring to the drawings and first to FIG. 1, a typical high intensity discharge lamp fixture 10 is shown housing a high intensity discharge lamp. The window in the fixture through which the light emanates is opposite the fixture casting 12 to which mounting pad 14 is attached. In the preferred embodiment, mounting pad 14 is attached to fixture casting 12 by way of mounting screws (not shown). Alternatively, mounting pad 14 may be welded to the fixture casting.

The bracket arrangement of the fixture mounting apparatus, which is described more fully hereinafter, is attached to a post receiving means 16. Typically, post receiving means 16 is an annular tubing slightly larger than post 18 over which it slips during installation. Post receiving means 16 may be fixedly secured to ballast housing 20. A cable connection 22 permits connection of the ballast to the lighting fixture in housing 10. Screws (not shown) tapped through post receiving means 16 permits tightening of means 16 to post 18 at the desired vertical height of the lamp and provides horizontal adjustment of the aiming range when the post receiving means is rotated about the post.

Now referring to FIG. 3, a prior art structure is shown for providing vertical adjustment of a lighting fixture similar to that illustrated in FIG. 1. In this structure, arms 30 and 32 are connected to a post receiving means by bolts 34 and 36, respectively. As noted, each of these arms has a mounting surface for mating with a mounting surface of the post receiving means, the mounting bolts passing therethrough. Alternatively, the arms may be cast in one continuous piece.

At the ends of the arms opposite bolts 34 and 36, arms 30 and 32 are attached to the housing 10 of the lighting fixture at pivot points 38 and 40, respectively, Typically, these pivot points are each provided by a bolt passing through the end of the arm into the housing of the light fixture. It should be noted that 38 and 40 are axially aligned with one another so as to permit housing 10 to be angled at any desired vertical angle, assuming post receiving means has been slipped over a vertical post. The pivot bolts are tightened when the desired aiming range position of the fixture has been set at the desired aiming angle.

As illustrated in FIG. 3, arms 30 and 32 are typically manufactured from castings. Hairline defects in the casting may result in failure of the metal from fatigue since the arms are relatively lengthy and the weight is carried at some distance from their mounting positions at bolts 34 and 36.

To avoid the shortcoming of the prior art structure illustrated in FIG. 3, the mounting apparatus of the preferred embodiment shown in FIG. 1 is pivoted at a distance which does not pass through an axis internal within the lighting fixture. This is provided by U-shaped bracket 50, the base of which mates with mounting pad 14 and is secured thereto via bolts 52 and 54. Note further that mounting pad 14 is triangular shaped to improve the momentof-force stress characteristics of the fixture housing with respect to the bracket. The legs of the U-shaped bracket receive an axle 56. Axle 56 has a bolt head on one end and is threaded to receive a nut 58 on the opposite end. Flat washers may be used underneath bolt head 56 and nut 58.

The U-shaped legs of the bracket fit around a hub projection 60 from the post receiving means so that when nut 58 is tightened, the bracket is secured in place at the desired vertical position for the light fixture.

As is best illustrated in FIG. 4, the pivot or axle arrangement just described permits a vertical adjustment for the light fixture through a range of about 160°. Depending upon the dimension of hub projection 60, a range of close to 180° may be provided.

Of particular convenience, the holes in the base of the bracket for receiving bolts 52 and 54 may conveniently be key-hole slots 62 and 64, respectively, as shown in FIG. 5.

In operation, it may be seen that the post receiving means attached to bracket 50 may be slipped over post 18 independent of light fixture 10 and tightened temporarily in place on post 18 at the approximate desired location. Light fixture 10 may be temporarily mounted via bolts 52 and 54 and key-hole 62 and 64, independent of any tools for tightening bolts 52 and 54 in their slots. After the installer is satisfied with the temporary installation, bolts 52 and 54 may be subsequently tightened. Horizontal adjustment of the aiming range of the lighting fixture may be made by loosening the bolts in receiving means 16 and making the adjustment with respect to pipe 18. Vertical adjustment may be made by loosening nut 58 on axis 56 so as to permit the aiming range of the lighting fixture to be adjusted anywhere within the range shown in FIG. 4. The long arms 30 and 32 shown in FIG. 3 are hence avoided altogether.

While a particular embodiment of the invention has been shown, it will be understood that the invention is not limited thereto. For example, separate pivot means may be provided with respect to each leg of the U-shaped bracket so long as the pivot means are axially aligned. Many other modifications may also be made and will be apparent to those skilled in the art.

What is claimed is:

1. A light fixture housing, comprising:

an angled mounting pad fixedly secured to the casing of said fixture providing a flat mounting surface, a U-shaped bracket for attaching to said mounting pad and having a flat base surface for mating with said mounting surface of said mounting pad, said base surface including at least one key-hole slot, said mounting pad including a receiving hole for a bolt, the head of which operates within said key-hole slot, pivot means mounted within the legs of said U-shaped bracket having an axle with at least one threaded end for receiving a nut to provide tightening of said axle to said bracket at a selectable aiming angle for said housing.

2. A light fixture as described in claim 1, wherein said pivot means is fixedly secured to post receiving means for permitting adjustment at right angles to the adjustment provided by said pivot means.

3. A light fixture as described in claim 1, wherein said pivot means provides adjustment over an aiming range angle between −80° and +80°.

4. A light fixture as described in claim 1, wherein said mounting pad provides a mounting surface at an acute angle with respect to the adjoining surface of the light fixture.

* * * * *